US006050784A

United States Patent [19]

Kawada et al.

[11] Patent Number: 6,050,784

[45] Date of Patent: Apr. 18, 2000

[54] COMPRESSOR HAVING CAPACITY-CONTROLLING MECHANISM WITH ABRASION-FREE CYLINDER

[75] Inventors: Minoru Kawada; Mikihiko Ishii, both of Nishi-kasugai-gun, Japan

[73] Assignee: Mitsubishi Heavy Industries, Ltd., Tokyo, Japan

[21] Appl. No.: 09/190,180

[22] Filed: Nov. 12, 1998

[30] Foreign Application Priority Data

Nov. 14, 1997 [JP] Japan ..... 9-329661

[51] Int. Cl.[7] ..... F04B 53/12

[52] U.S. Cl. ..... 417/310

[58] Field of Search ..... 417/310; 137/458, 137/569

[56] References Cited

U.S. PATENT DOCUMENTS

| | | | |
|---|---|---|---|
| 4,558,993 | 12/1985 | Hori et al. . | |
| 5,222,576 | 6/1993 | Meuer et al. | 417/310 |
| 5,236,316 | 8/1993 | Iio | 417/310 |
| 5,513,960 | 5/1996 | Uemoto | 417/310 |
| 5,639,225 | 6/1997 | Matsuda et al. | 417/310 |
| 5,810,565 | 9/1998 | Eppli | 417/310 |
| 5,919,033 | 7/1999 | Singleterry et al. | 417/310 |
| 5,993,171 | 11/1999 | Higashiyama | 417/310 |
| 5,993,177 | 11/1999 | Terauchi et al. | 417/310 |

FOREIGN PATENT DOCUMENTS

| | | | |
|---|---|---|---|
| 0 486 120 | 5/1992 | European Pat. Off. | 417/310 |
| 0 555 945 | 8/1993 | European Pat. Off. | 417/310 |
| 3-237285 | 10/1991 | Japan . | |
| 4-179886 | 6/1992 | Japan . | |

*Primary Examiner*—Erick R. Solis
*Attorney, Agent, or Firm*—Oblon, Spivak, McClelland, Maier & Neustadt, P.C.

[57] ABSTRACT

A compressor having a capacity-controlling mechanism is provided, by which the inner-peripheral surface of a blind opening provided in a piston is subjected to abrasion due to sliding and rotating motions of a coil spring in the piston. In the capacity-controlling mechanism, the coil spring is covered by a cover made of abrasion resistant material and the covered coil spring is arranged in the blind opening, or a head of the coil spring is engaged to an inner surface of the blind opening.

2 Claims, 4 Drawing Sheets

COMPRESSOR HAVING CAPACITY-CONTROLLING MECHANISM WITH ABRASION-FREE CYLINDER

BACKGROUND OF THE INVENTION

1. Field of the Invention

The present invention relates to a compressor suitable for an air conditioner in a vehicle or the like.

This application is based on Patent Application No. Hei 9-329661 filed in Japan, the contents of which are incorporated herein by reference.

2. Description of the Related Art

FIGS. 3–5 show an example of a conventional scroll-type compressor. FIG. 3 is a sectional view in the longitudinal direction, FIG. 4 is a sectional view along line "F—F" in FIG. 3, and FIG. 5 is a sectional view along line "G—G" in FIG. 4.

In FIG. 3, reference numeral 1 indicates a closed housing which comprises cup-like main body 2, front end plate 4 fastened to the body 2 using bolt 3, and cylindrical member 6 fastened to the front end plate 4 using bolt 5.

Main shaft 7 is provided through cylindrical member 6, and is supported in a freely rotatable form via bearings 8 and 9.

In the closed housing 1, fixed scroll 10 and revolving scroll 14 are provided.

The fixed scroll 10 comprises end plate 11 and spiral lap 12 disposed on surface 11*a* of the plate 11, and the surface facing end plate 15 which is explained later. The end plate 11 is fastened to cup-like main body 2 via bolt 13.

The revolving scroll 14 comprises end plate 15 and spiral lap 16 which is disposed on surface 15*a* of the plate 15, and the surface facing the end plate 11. This spiral lap 16 has substantially the same shape as spiral lap 12 included in fixed scroll 10. The axes of the revolving and fixed scrolls 14 and 10 are separated from each other by a predetermined distance, that is, they are in an eccentric relationship. In addition, the phases of these scrolls differ by 180°, and they are engaged with each other as shown in FIG. 3.

Accordingly, tip seals 17, provided and buried at each head surface of spiral lap 12, are in close contact with surface 15*a* of end plate 15, while tip seals 18, provided and buried at each head surface of spiral lap 16, are in close contact with surface 11*a* of end plate 11. As shown in FIG. 4, the side faces of spiral laps 12 and 16 have line contact at plural positions a, b, c, d and thus plural compression chambers 19*a* and 19*b* are formed essentially at positions of point symmetry with respect to the center of the spiral.

Inside projecting disk-shaped boss 20, provided at a center area in the outer surface (opposite to inner surface 15*a*) of end plate 15, drive bush 21 is inserted in a freely rotatable form via revolving bearing 23. Slide hole 24 is provided in the drive bush 21, and eccentric drive pin 25 is inserted into the slide hole 24 so as to perform a freely-sliding motion of the pin. The projecting drive pin 25 is eccentrically provided on an end face of larger-diameter portion 7*a* of main shaft 7, the portion 7*a* being provided on an end at the main body 2 side of the rotational shaft 7.

Reference numeral 26 indicates a rotation-blocking mechanism which also functions as a thrust bearing, the mechanism being provided between the peripheral edge of the outer surface of end plate 15 and an inner surface of front end plate 4. Reference numeral 27 indicates a balance weight attached to drive bush 21, reference numeral 28 indicates a suction chamber, reference numeral 29 indicates a discharge port provided by boring a central part of end plate 11 of the fixed scroll, reference numeral 30 indicates a discharge valve, reference numeral 31 indicates a discharge cavity, and reference numeral 32 indicates a balance weight attached to the larger-diameter portion 7*a* of main shaft 7. Reference numeral 35 indicates a retainer for restricting the rising motion of discharge valve 30, reference numeral 36 indicates a bolt for fastening the discharge valve 30 and the retainer 35 to end plate 11, and reference numeral 38 indicates a control valve.

According to the above structure, when the main shaft 7 is rotated, revolving scroll 14 is driven via eccentric drive pin 25, drive bush 21, revolving bearing 23, and boss 20, and the revolving scroll 14 revolves while rotation of the scroll 14 is prohibited by the rotation-blocking mechanism 26.

In this way, the above-mentioned line-contact portions a to d in the side faces of spiral laps 12 and 16 gradually move toward the center of the "swirl", and thereby compression chambers 19*a* and 19*b* also move toward the center of the swirl while the volume of each chamber is gradually reduced.

Accordingly, gas, which has flowed into suction chamber 28 through an inlet (not shown), enters from an opening which is limited by outer peripheral edges of spiral laps 12 and 16 into compression chambers 19*a* and 19*b*. This gas is gradually compressed and reaches central chamber 22. From the central chamber, the gas passes through discharge port 29, and presses and opens discharge valve 30, and thereby the gas is discharged into discharge cavity 31. The gas is then discharged outside via an outlet not shown.

As shown in FIG. 4, in the end plate 11 of fixed scroll 10, a pair of cylinders 32*a* and 32*b* are provided, an end of each cylinder being opened to suction chamber 28 and these cylinders being provided at both sides of discharge port 29 in a parallel form and with a specific distance between them.

Additionally, in the end plate 11, bypassing holes 33*a* and 33*b* are provided for bypassing the gas during compression from the pair of compression chambers 19*a* and 19*b* to the above cylinders 32*a* and 32*b*, and bypassing paths 44*a* and 44*b* are also provided for making the gas successively pass through the discharge port 29 and the cylinders 32*a* and 32*b*.

As shown in FIG. 5, control pressure chamber 37*b* is limited in cylinder 32*b* by closely inserting piston 34*b* for opening or closing the bypassing hole 33*b* and the bypassing path 44*b* into the cylinder 32*b*. Here, piston 34*b* can freely slide in the cylinder 32*b*.

In the piston 34*b*, hole 46*b* for opening/closing the bypassing hole 33*b* and hole 47*b* for opening/closing the bypassing path 44*b* are provided.

In blind opening 45 provided in piston 34*b*, coil spring 41*b* is arranged, one end thereof being disposed on the bottom of the blind opening 45*b*, while the other end is supported by spring bearing 40*b*.

At the time of a full-loading operation of the compressor, a high-pressure gas for control, generated via control valve 38, is introduced via through hole 39*b* into control pressure chamber 37*b*. Accordingly, the piston 34*b* proceeds against the impact-resilience force of coil spring 41*b* so that the piston 34*b* is positioned as shown in FIG. 5 and the bypassing hole 33*b* and bypassing path 44*b* are closed.

On the other hand, when in an operation mode with a controlled (or reduced) capacity, the pressure of the control gas generated via the control valve 38 is gradually lowered. Accordingly, the piston 34*b* receives impact-resilience force of coil spring 41*b* and moves backward. When hole 46*b* aligns with bypassing hole 33*b*, the gas subjected to the compression flows through bypassing hole 33*b*, and further passes through hole 46*b*, blind opening 45*b*, and cylinder 32*b* and is injected into suction chamber 28.

If the pressure of the control gas generated via the control valve 38 is further lowered, the positions of hole 47*b* and bypassing path 44*b* align with each other. Accordingly, the gas from discharge port 29 is introduced via bypassing path 44*b*, hole 47*b*, blind opening 45*b*, and cylinder 32*b* into suction chamber 28, and the capacity of the compressor becomes zero.

The structure and operation of cylinder 32*a* are generally the same as those of the cylinder 32*b*.

In the above-explained scroll-type compressor, when piston 34*b* slides in cylinder 32*b*, coil spring 41*b* extends or shrinks, and simultaneously rotates. Therefore, the outer-peripheral portions of the coil spring 41*b* are in contact with the inner-peripheral surface of the blind opening 45*b*, and the contact areas are subjected to abrasion.

SUMMARY OF THE INVENTION

An object of the present invention is to solve the above problem in which the inner-peripheral surface of the blind opening is subjected to abrasion.

Therefore, the present invention provides a compressor comprising a capacity-controlling mechanism which includes a control pressure chamber with a controlled pressure, the chamber being limited by closely inserting a piston into a cylinder in a freely sliding form, and a gas during and/or after compression being bypassed by moving the piston against the impact-resilience force of a coil spring arranged in a blind opening provided in the piston, wherein the coil spring is covered by a cover made of abrasion resistant material and the covered coil spring is arranged in the blind opening.

Accordingly, contact between the outer peripheral portions of the sliding piston and the inner-peripheral surface of the blind opening can be avoided, thereby avoiding abrasion of said inner-peripheral surface.

The present invention also provides a compressor comprising a capacity-controlling mechanism which includes a control pressure chamber with a controlled pressure, the chamber being limited by closely inserting a piston into a cylinder in a freely sliding form, and a gas during and/or after compression being bypassed by moving the piston against the impact-resilience force of a coil spring arranged in a blind opening provided in the piston, wherein a head of the coil spring is engaged to an inner surface of the blind opening.

In this case, rotation of the coil spring inside the blind opening cannot occur. Therefore, contact can also be avoided between the outer peripheral portions of the sliding piston and the inner-peripheral surface of the blind opening, thereby avoiding abrasion of said inner-peripheral surface.

DESCRIPTION OF THE PREFERRED EMBODIMENTS

Figure 1:
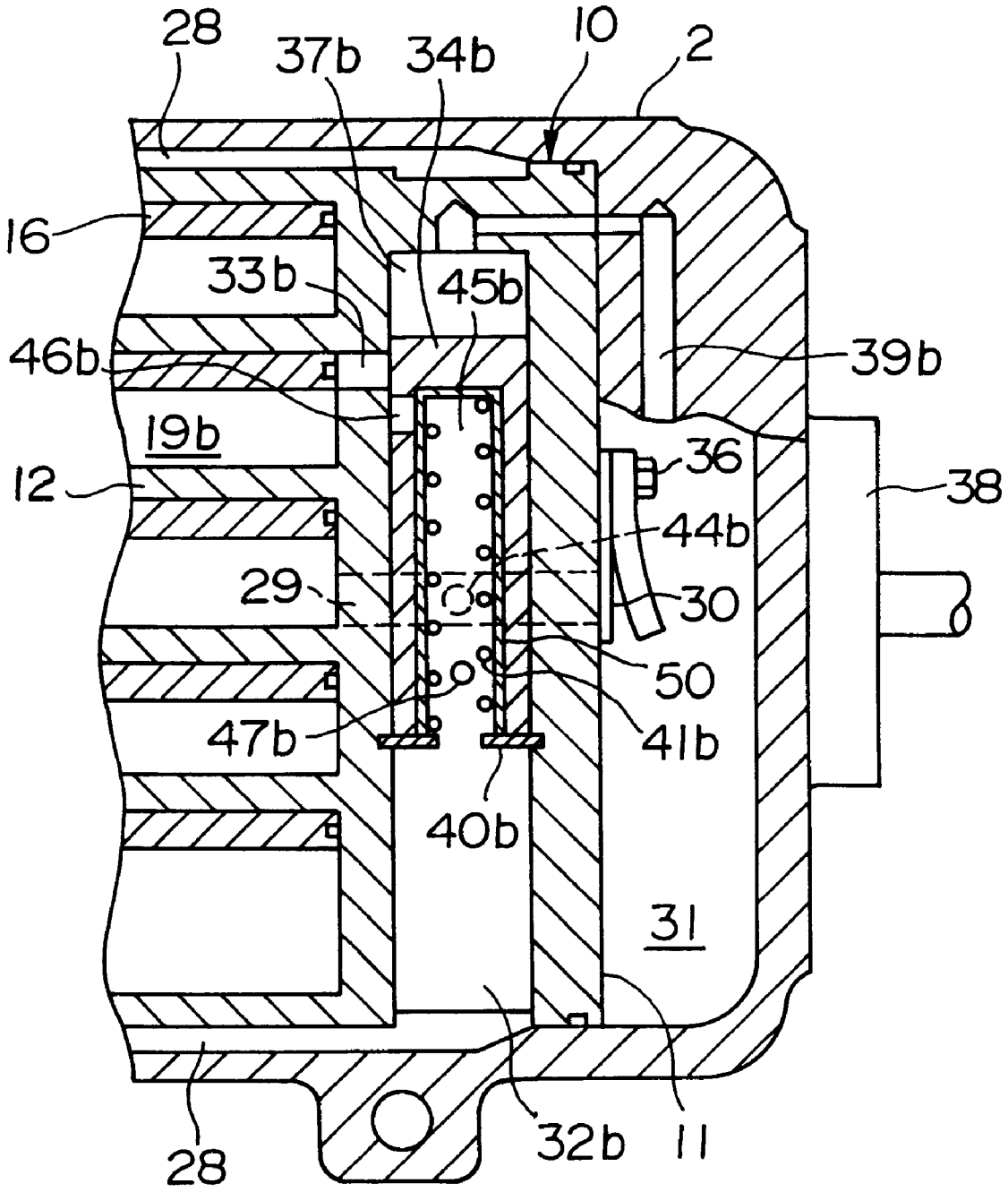
FIG. 1 is a partially sectional view in the longitudinal direction, which shows the first embodiment according to the present invention.
Figure 3:
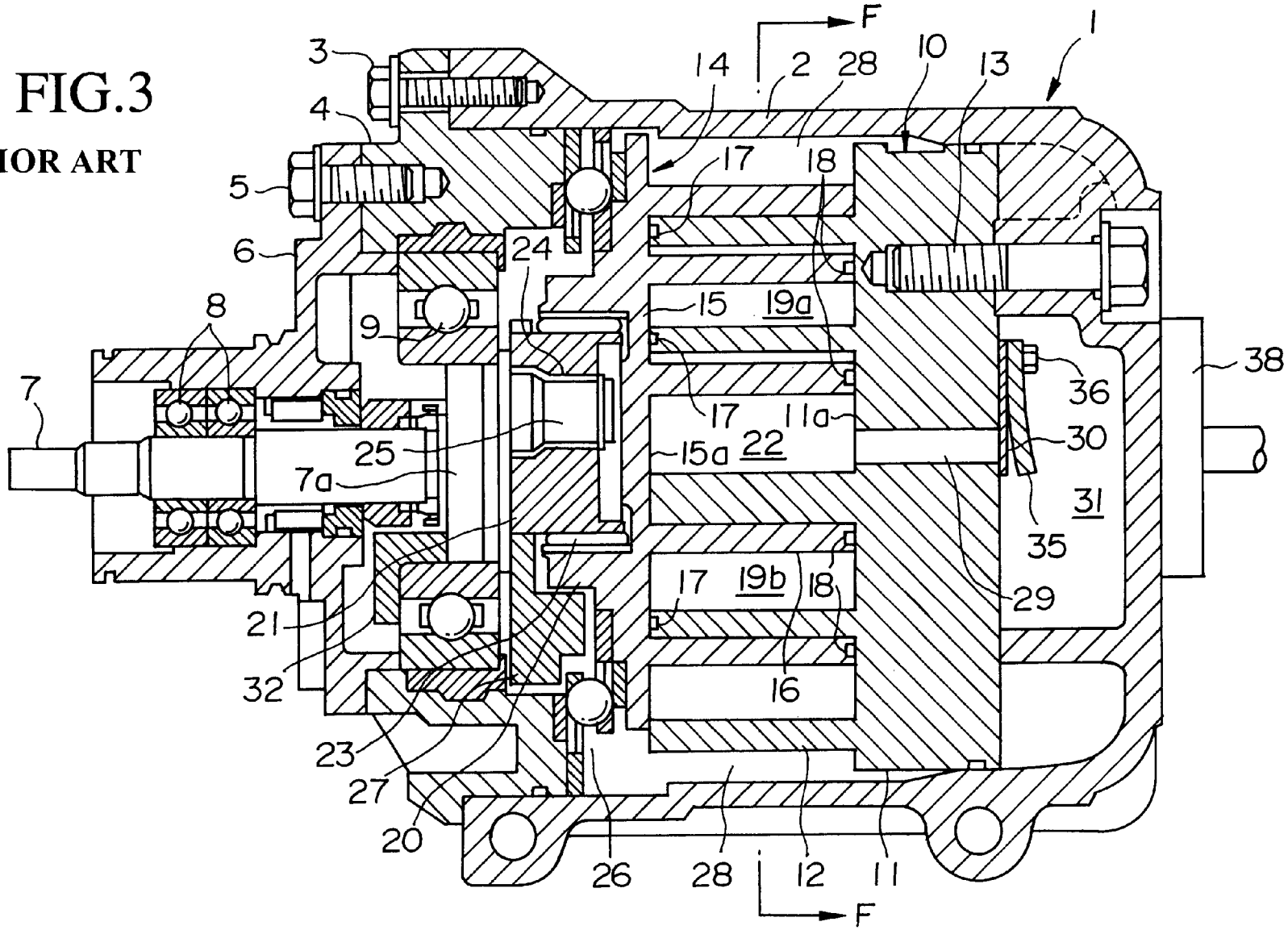
FIG.3 PRIOR ART
FIG. 3 is a partially sectional view in the longitudinal direction, which shows a conventional scroll-type compressor.
Figure 4:
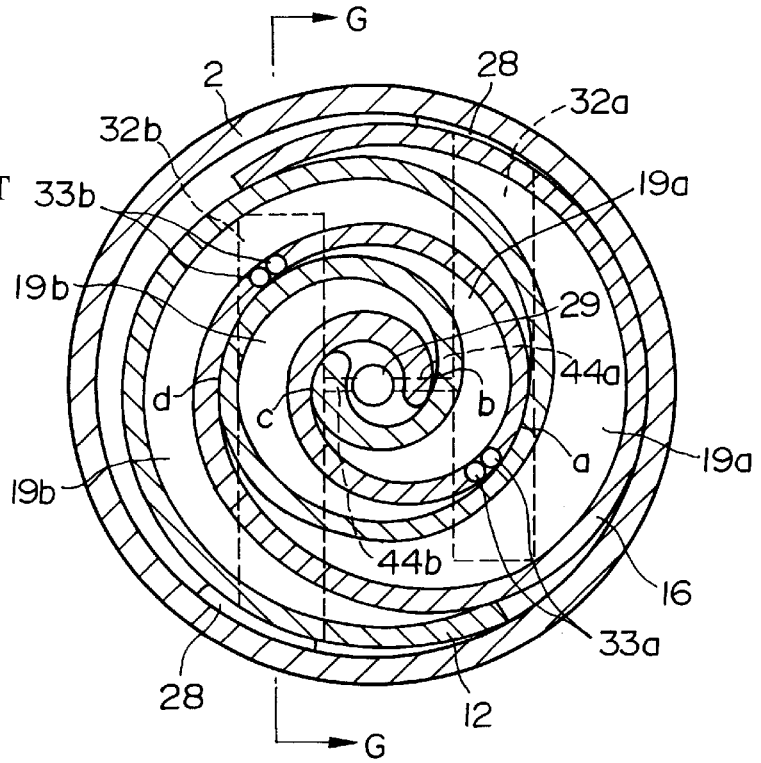
FIG.4 PRIOR ART
FIG. 4 is a sectional view along line "F—F" in FIG. 3.
Figure 5:
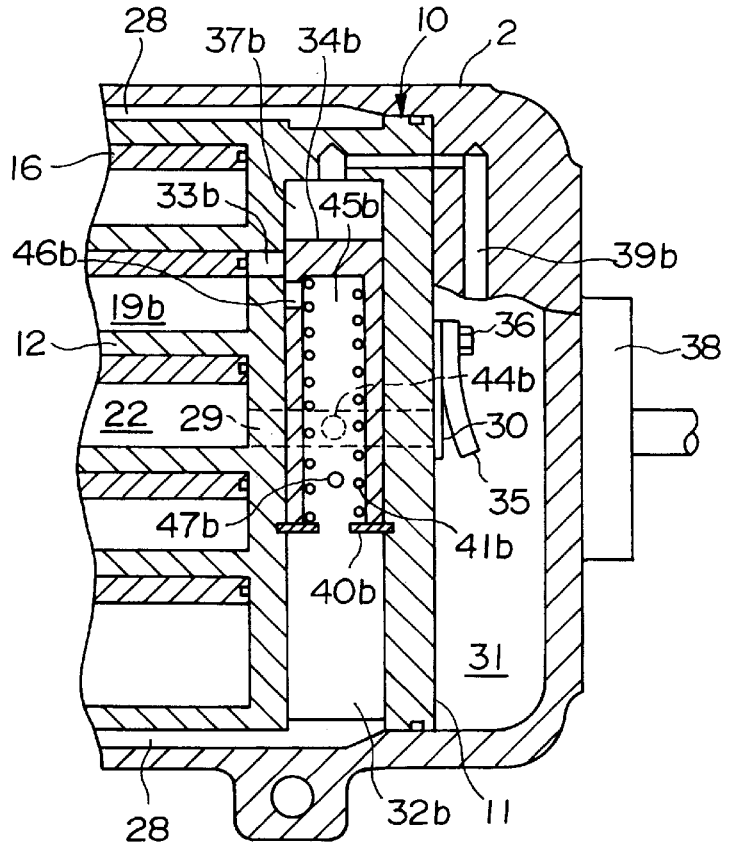
FIG.5 PRIOR ART
FIG. 5 is a sectional view along line "G—G" in FIG. 4.

The first embodiment of the present invention is shown in FIG. 1, which is a partially sectional view in the longitudinal direction. In FIG. 1, coil spring 41*b* is covered with a cover 50 which is made of abrasion resistant material, and the covered coil spring 41*b* is arranged in the blind opening 45. Other parts are identical to those shown in FIGS. 3–5, and thus are given identical reference numbers and explanations thereof are omitted here.

In the present embodiment, when in an operation mode with a controlled (or reduced) capacity, even when the coil spring 41 extends and shrinks due to a reciprocating motion of piston 34*b*, the outer-peripheral portions of the spring are not in direct contact with the inner-peripheral surface of the blind opening 45*b*. Therefore, abrasion of the inner-peripheral surface of the blind opening 45*b* can be avoided.

Figure 2:
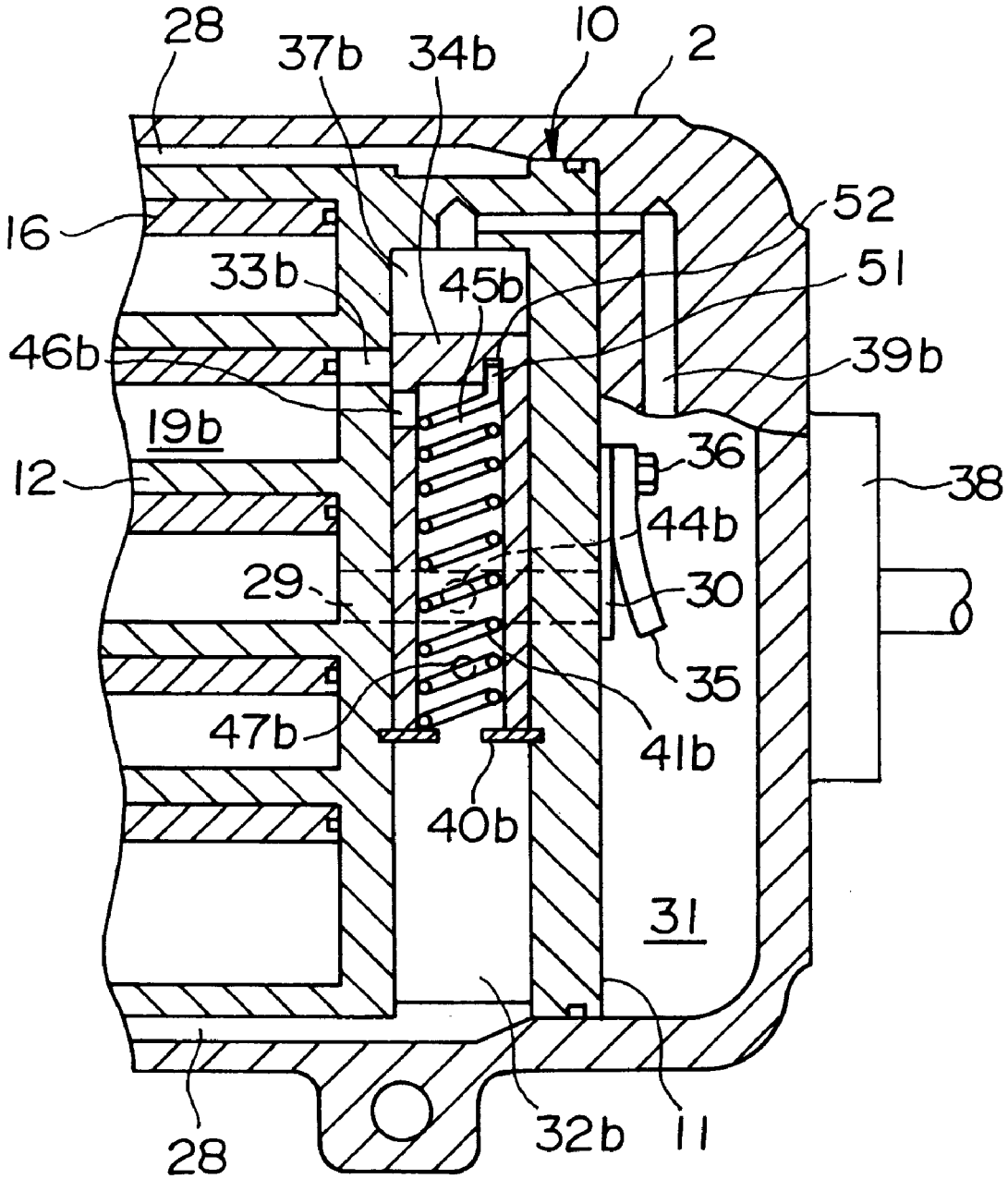
FIG. 2 is a partially sectional view in the longitudinal direction, which shows the second embodiment according to the present invention.

The second embodiment of the present invention is shown in FIG. 2, which is a partially sectional view in the longitudinal direction. In FIG. 2, head 51 of coil spring 41*b* is bent so that the bent head 51 projects in the direction of extension (or shrinkage) of the spring and is engaged in small hole 52 which is provided in the bottom of the blind opening 45*b*. Other parts are identical to those shown in FIGS. 3–5, and thus are given identical reference numbers and explanations thereof are omitted here.

In the present embodiment, even when the coil spring 41 extends and shrinks due to a reciprocating motion of piston 34*b*, the head 51 is engaged in small hole 52, and thus coil spring 41*b* does not rotate inside the blind opening 45*b*. Accordingly, it is possible to avoid abrasion of the inner-peripheral surface of the blind opening 45*b* due to relative rotation of the coil spring 41*b* with respect to said inner-peripheral surface while both are in contact with each other.

In the above capacity-control mechanism, the gas during or after the compression is bypassed; however, only one of the gas during the compression and the gas after the compression may be bypassed.

The above are explanations of the embodiments obtained by applying the present invention to a scroll-type compressor comprising a pair of capacity-controlling mechanisms. However, the present invention may also be applied to a scroll-type compressor comprising a single capacity-controlling mechanism, examples of which are disclosed in Japanese Patent Application, First Publication, Nos. Hei 3-237285 and Hei 4-179886. Furthermore, the present invention may be applied to any type of compressor such as a rolling-piston type.

What is claimed is:

1. A compressor comprising a capacity-controlling mechanism which includes a control pressure chamber with a controlled pressure, the chamber being limited by closely inserting a piston into a cylinder in a freely sliding form, and a gas during and/or after compression being bypassed by moving the piston against the impact-resilience force of a coil spring arranged in a blind opening provided in the piston, wherein:

the coil spring is covered by a cover made of abrasion resistant material and the covered coil spring is arranged in the blind opening.

2. A compressor comprising a capacity-controlling mechanism which includes a control pressure chamber with a controlled pressure, the chamber being limited by closely inserting a piston into a cylinder in a freely sliding form, and a gas during and/or after compression being bypassed by moving the piston against the impact-resilience force of a coil spring arranged in a blind opening provided in the piston, wherein:

a head of the coil spring is engaged to an inner surface of the blind opening.

* * * * *